US007463211B2

(12) United States Patent
Mertel et al.

(10) Patent No.: US 7,463,211 B2
(45) Date of Patent: Dec. 9, 2008

(54) ADJUSTABLE ANTENNA ELEMENT AND ANTENNAS EMPLOYING SAME

(75) Inventors: Michael E. Mertel, Medina, WA (US); Clayton B Curtiss, Lacey, WA (US); James E. Thomas, Issaquah, WA (US)

(73) Assignee: Fluid Motion, Inc., Bellevue, WA (US)

( * ) Notice: Subject to any disclaimer, the term of this patent is extended or adjusted under 35 U.S.C. 154(b) by 21 days.

(21) Appl. No.: 11/684,323

(22) Filed: Mar. 9, 2007

(65) Prior Publication Data

US 2007/0229386 A1 Oct. 4, 2007

Related U.S. Application Data

(60) Provisional application No. 60/743,874, filed on Mar. 28, 2006.

(51) Int. Cl.
*H01Q 21/12* (2006.01)

(52) U.S. Cl. ..... 343/815; 343/810; 343/817; 343/823

(58) Field of Classification Search ..... 343/815, 343/817, 819, 810, 823, 722, 745, 830
See application file for complete search history.

(56) References Cited

U.S. PATENT DOCUMENTS

| | | | | |
|---|---|---|---|---|
| 2,476,469 | A | 7/1949 | Walker | |
| 2,632,107 | A | 3/1953 | Hlivjak | |
| 2,967,300 | A | 1/1961 | Haughawout | |
| 3,487,415 | A | 12/1969 | Simons | |
| 3,653,056 | A | 3/1972 | Peterson | |
| 3,683,391 | A | 8/1972 | Callaghan | |
| 3,931,626 | A * | 1/1976 | Simons | 343/815 |
| 3,971,031 | A | 7/1976 | Burke | |
| 4,028,709 | A | 6/1977 | Berkowitz et al. | |
| 4,145,694 | A * | 3/1979 | Sletten | 343/727 |
| 4,290,071 | A | 9/1981 | Fenwick | |
| 4,514,734 | A * | 4/1985 | Cermignani et al. | 343/708 |
| 4,604,628 | A | 8/1986 | Cox | |
| 4,785,308 | A | 11/1988 | Newcomb | |

(Continued)

OTHER PUBLICATIONS

Gibson, William, "A Teletuned 10-Meter Beam," QST, Cover Page and p. 35, Aug. 1952.

(Continued)

*Primary Examiner*—Tho G Phan
(74) *Attorney, Agent, or Firm*—Lewis and Roca LLP

(57) ABSTRACT

An antenna system with at least one tunable dipole element with a length adjustable conductive member disposed. The element is made of two longitudinally aligned, hollow support arms made of non-conductive material. Disposed longitudinally inside each element is a length adjustable conductive member electrically connected at one end. Each conductive member is stored on a spool that is selectively rotated to extend the conductive member into the support arm. The support arms are affixed at one end to a rigid housing. During use, the conductive members are adjusted in length to tune the element to a desired frequency. The antenna can be optimally tuned at a specific frequency for maximum gain, maximum front-to-back ratio, as a bi-directional antenna, and to provide a desired feed point impedance. An electronic control system allows the length of the conductive members to be manually or automatically adjusted to a desired frequency.

39 Claims, 3 Drawing Sheets

U.S. PATENT DOCUMENTS

| | | | | |
|---|---|---|---|---|
| 5,061,944 | A | 10/1991 | Powers et al. | |
| 5,189,435 | A | 2/1993 | Yarsunas et al. | |
| 5,293,172 | A * | 3/1994 | Lamberty et al. | 343/701 |
| 5,841,406 | A | 11/1998 | Smith | |
| 5,865,390 | A | 2/1999 | Iveges | |
| 5,945,962 | A | 8/1999 | Harrington et al. | |
| 5,995,061 | A | 11/1999 | Schiller | |
| 6,154,180 | A | 11/2000 | Pardrick | |
| 6,300,912 | B1 | 10/2001 | Pla | |
| 6,677,914 | B2 | 1/2004 | Mertel | |
| 7,205,953 | B2 * | 4/2007 | Knadle et al. | 343/792.5 |
| 2005/0237256 | A1 * | 10/2005 | Regala | 343/810 |

OTHER PUBLICATIONS

Advertisement for "Cliff-Dweller" by New-Tronics, Model CD 40-75, QST, p. 138, Dec. 1964.

Advertisement for New-Tronics Cliff-Dweller™, QST, p. 109, date unknown.

* cited by examiner

| L | D | IMPEDANCE |
|---|---|---|
| 38' | 24" | 18.7Ω |
| 38' | 48" | 23.7Ω |
| 46' | 24" | 39.1Ω |
| 46' | 48" | 44.4Ω |

ADJUSTABLE ANTENNA ELEMENT AND ANTENNAS EMPLOYING SAME

CROSS-REFERENCE TO RELATED APPLICATIONS

This application claims benefit of U.S. Provisional Patent Application Ser. No. 60/743,874, filed Mar. 28, 2006, the entirety of which is incorporated by reference herein.

BACKGROUND

1. Technical Field

The present invention relates to the field of radio antennas, and to wide frequency coverage vertical, dipole and parasitic array antennas. More particularly, the present invention relates to an adjustable antenna element, and to antenna systems employing one or more such adjustable elements.

2. Description of the Prior Art

Antenna systems employing a single antenna having adjustable-length elements providing excellent performance over a wide frequency range are known in the art. Examples of such antenna systems are the antenna systems manufactured and sold by Steppir Antennas of Issaquah, Wash., and include dipole, vertical, and yagi antennas.

A limiting factor in prior-art antennas is that, as the frequency of operation of the antenna becomes lower, the physical length of the antenna element must increase to allow it to resonate at the selected frequency. For example, in the case of a yagi antenna having two or more elements extending outward from a boom support arm, element lengths of up to 70 feet are necessary for operation at frequencies in the 40-meter band (7.0 through 7.3 MHz). For operation in the 80 meter band (3.5 through 4.0 MHz) element lengths are up to 140 feet. Of course, elements such as loading coils can be used to shorten the physical lengths of the antenna elements, but they degrade the performance of the antenna.

Mechanical considerations for constructing such antennas become more complicated as the element lengths increase as the operating frequency decreases. Considerations such as mechanical stress and wind survivability make the design of such adjustable antenna systems more challenging when long element lengths are necessary.

BRIEF DESCRIPTION

Disclosed herein is an adjustable antenna element for use in an antenna system of the type that employs adjustable-length conductive members that are deployed in hollow support arms and use a means such as a stepper motor for adjusting the length of the two conductive members inside the support arms.

The present invention is particularly suitable for use in antenna systems of the type disclosed in U.S. Pat. No. 6,677,914. The entire disclosure of U.S. Pat. No. 6,677,914 is expressly incorporated herein by reference.

The antenna element of the present invention comprises a hollow support arm formed from non-conductive material and having a first section extending in a first direction for a first length, a curved transition section and a second section extending in a second direction for a second length. As presently preferred, the first and second sections are essentially equal in length and the curved transition section is formed as a 180° radial curve, although other angles and shapes could be used. A length-adjustable conductive member is disposed in the hollow support arm. A length-adjuster is configured to adjust the length of the conductive member disposed in the hollow support arm. If the antenna element is to be a driven element, a transmission-line is electrically coupled to the conductive member.

In the preferred embodiment, the conductive member is adjusted by employing two spools located inside the housing unit in which the conductive member is wound. During use, the conductive member is selectively wound and unwound from a spool so that the conductive member moves inside the support arm. At least one motor is provided inside the housing unit that rotates the spool to precisely control the length of the conductive member inside the support arm.

According to one particular embodiment of the invention, the conductive member is formed from a beryllium-copper strip that travels out into a rigid, hollow fiberglass support tube. The fiberglass tube has a 180° "sweep" tube with a radius (12" has been found to be suitable) that the tape follows around to an identical fiberglass tube that then guides the tape back towards the other end of the support tube. By doing this, the overall length of the antenna element required for operation of a yagi antenna on 40 meters has been reduced from 64 feet to down to a mere 38 feet.

In one embodiment of antenna systems where the adjustable antenna element is to be attached to a boom support structure, both ends of the hollow support arm are disposed in the same horizontal plane. One end of the hollow support arm is attached to the boom by a housing that contains the length adjuster apparatus. The other end of the hollow support arm is mechanically attached to the boom. In another embodiment of antenna systems where the adjustable antenna element is to be attached to a boom support structure, one end of the hollow support arm is attached to the boom by a housing that contains the length adjuster apparatus. The other end of the hollow support arm is disposed at a vertical position either above or below the boom and is mechanically attached to the boom using a suitable support bracket.

In an antenna system according to the present invention that is configured as a dipole antenna, first and second hollow support arms are formed from a non-conductive material and each have a first section extending in a first direction for a first length, a curved transition section and a second section extending in a second direction for a second length. As presently preferred, the first and second sections are essentially equal in length and the curved transition section is formed as a 180° radial curve but other angles and shapes could be used. First and second length-adjustable conductive members are disposed, respectively, in the first and second hollow support arms. A length-adjuster is configured to adjust the lengths of the first and second conductive members disposed in the first and second hollow support arms. If the antenna element is to be a driven element, a transmission-line coupler is electrically coupled to the first and second conductive members.

In an antenna system according to the present invention that is configured as a yagi antenna, at least one element of the antenna is comprises first and second hollow support arms formed from a non-conductive material, each having a first section extending in a first direction for a first length, a curved transition section and a second section extending in a second direction for a second length. As presently preferred, the first and second sections are essentially equal in length and the curved transition section is formed as a 180° radial curve but other angles and shapes could be used. First and second length-adjustable conductive members are disposed, respectively, in the first and second hollow support arms. A length-adjuster is configured to adjust the lengths of the first and second conductive members disposed in the first and second hollow support arms. If the antenna element is to be a driven element, a transmission-line coupler is electrically coupled to the first and second conductive members. The other elements of the yagi antenna may be configured in accordance with the present invention or may be configured as disclosed in U.S. Pat. No. 6,677,914.

This method is a form of linear loading that is done at the end of the element instead of the middle as is common in most antennas currently on the market. By doing the loading at the tip the very important high current area of the element near the middle is avoided. This is especially important when the element is used as a yagi element because it preserves the pattern (F/R) and gain much better than linear loading at the middle of the element. When used as a single element dipole this element is only −0.15 db below a full size dipole. The tape must be about 10% longer than it would be if it was laid out straight, but this presents no problems in the implementation or use of this element.

One significant advantage of folding the antenna element in this manner is that it lowers the impedance from the usual 50-70 ohms (depends on height above ground) of a full-length dipole down to 25 ohms. This allows using a 2:1 un/balun to match the dipole on 40 meters with 1.0:1 SWR without any switching by relays or otherwise. On 30 meters the tape forming the conductive member is barely around the sweep so it acts very much like a full length dipole and has an impedance of between about 50 ohms and about 70 ohms, resulting in a 2.0:1 SWR. However, it has been discovered that, in a yagi antenna employing the elements of the present invention, when fully extended the yagi director element intended for 20 meter and higher operation interacts with the dipole and lowers the SWR to 1.8:1 and also results in 2.68 dbi of gain and 1 db F/R.

As an illustrative example, using the antenna element of the present invention provides a stand-alone dipole antenna that can resonate at frequencies spanning wavelengths between 40 meters and 6 meters using an element having a length of only 38 feet. Such an element presents only 4 square feet of windload and its gain is only 0.15 db below a full size dipole on 40 meters.

The above antenna system is especially advantageous when configured as a Yagi-style antenna that can be optimally tuned at a specific frequency for maximum gain, maximum front-to-back ratio, and to provide a desired feed point impedance at the driven element. This allows a very large continuous range of frequencies to be covered with excellent performance and a very low voltage-standing-wave-ratio (VSWR) while using only one feed line. By using length adjustable elements and a shorter boom, the antenna system is able to achieve better performance than prior art antenna designs. Also incorporated into it is a Yagi-style antenna, enabling it to be quickly adjusted to change the direction of maximum signal strength 180 degrees by changing the length of the designated director to make it function as a reflector and conversely changing the length of the reflector to make it function as a director. In should also be understood that the antenna system can also function as a bi-directional style antenna by adjusting the reflector element to function as a director.

An electronic control system is provided that manually or automatically adjusts the length of the conductive members inside the antenna driven and parasitic elements to receive or transmit a desired frequency.

BRIEF DESCRIPTION OF THE DRAWING FIGURES

DETAILED DESCRIPTION

Those of ordinary skill in the art will realize that the following description of the present invention is illustrative only and not in any way limiting. Other embodiments of the invention will readily suggest themselves to such skilled persons.

Figure 1:
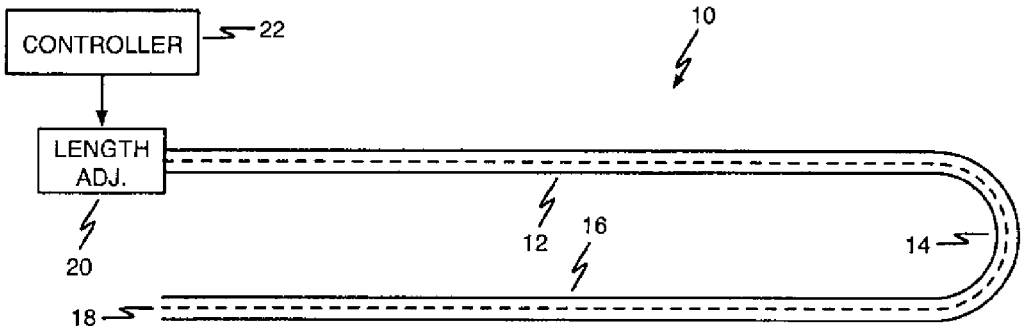
FIG. 1 is a drawing depicting an adjustable antenna element according to the present invention.

Referring first to FIG. 1, an illustrative antenna element 10 according to the present invention includes a hollow support arm including a first section 10, a curved transition section 14, and a second section 16. While it is presently preferred that first and second sections 12 and 16 be substantially straight, this is not a requirement. The hollow support arm is formed from a non-conductive material such as fiberglass.

The loop element is mechanically a more complex element than a straight element is and is subject to torques imparted by wind forces that can distort, bend, or kink the return loop. To prevent this would require the loop to be made of a suitable material such as fiberglass or something at least that strong. Fabricating a half circle hollow fiberglass tube is very expensive. Another solution according to the present invention is to take the stress off of the half-circle "sweep" by molding clamps of a material such as polycarbonate that firmly grip the tip of each straight element tip and allow a solid rod formed from a material such as fiberglass to connect the tips together through the plastic clamps thus taking all mechanical stress off of the sweeps. This allows the sweep to be made of inexpensive, flexible plastic tube such as polyethylene.

A length-adjustable conductive member 18 is disposed within the hollow support arm. Conductive member 18 may be formed from a material such as, but not limited to, beryllium copper, and may be advantageously formed as a perforated strip as disclosed in U.S. Pat. No. 6,677,914.

The conductive member 18 is mechanically coupled to a length adjuster 20 that functions to adjust the length of conductive member 18 that is disposed in the hollow support arm. The length adjuster 20 may be disposed in a suitable housing in order to provide mechanical support for the antenna element 10. As is known in the art, adjusting the length of the conductive member 18 may be accomplished by winding a perforated beryllium copper strip on a reel and causing it to wind and unwind from the reel and into and out of the hollow support arm by means of, for example, a stepper motor driving a sprocketed wheel that engages the perforations in the beryllium copper strip as taught in U.S. Pat. No. 6,677,914. The length adjuster 20 may be controlled by a controller 22 in the manner taught by U.S. Pat. No. 6,677,914.

Figure 2:
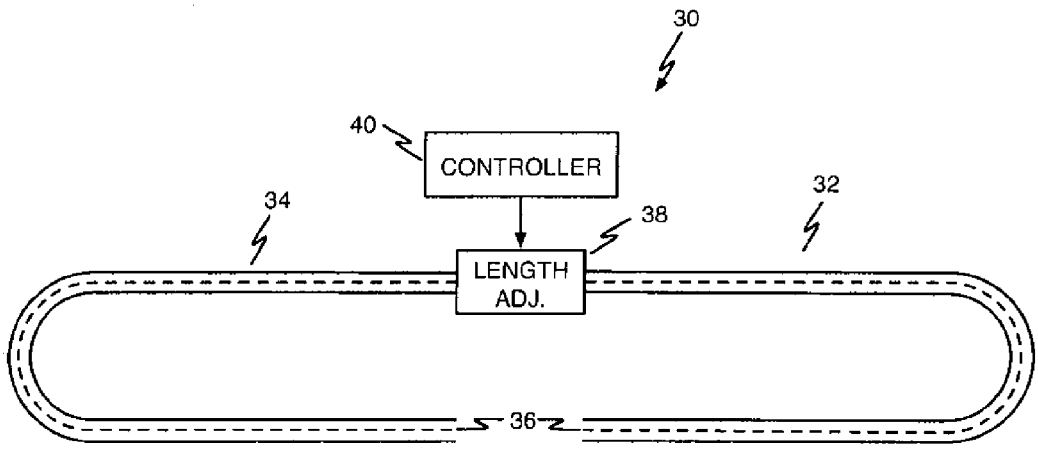
FIG. 2 is a drawing depicting a dipole antenna employing adjustable antenna elements according to the present invention.

Referring now to FIG. 2, an illustrative antenna element 30 according to the present invention includes a first hollow support arm 32 like that shown in FIG. 1. A second hollow support arm 34 extends in a direction opposite from that of support arm 32.

Each of support arms 32 and 34 include a length-adjustable conductive member 36 disposed within them. Conductive members 36 may be formed from a material such as, but not limited to, beryllium copper, and may be advantageously formed as a perforated strip as disclosed in U.S. Pat. No. 6,677,914.

The conductive members 36 are both mechanically coupled to a length adjuster 38 that functions to adjust the length of conductive members 18 that is disposed in the hollow support arms 32 and 34. The length adjuster 38 may be disposed in a suitable housing in order to provide mechanical support for the hollow support arms 32 and 34. As is known in the art, adjusting the length of the conductive members 36 may be accomplished by winding a perforated beryllium copper strip on a reel and causing it to wind and unwind from the reel and into and out of the hollow support arm by means of, for example, a stepper motor driving a sprocketed wheel that engages the perforations in the beryllium copper strip as taught in U.S. Pat. No. 6,677,914. The length adjuster 38 may be controlled by a controller 40 in the manner taught by U.S. Pat. No. 6,677,914. Persons of ordinary skill in the art will recognize that antenna element 30 is a dipole antenna whose operating frequency can be adjusted by changing the lengths of the conductive members 36 disposed within the support arms 32 and 34.

Figure 3:
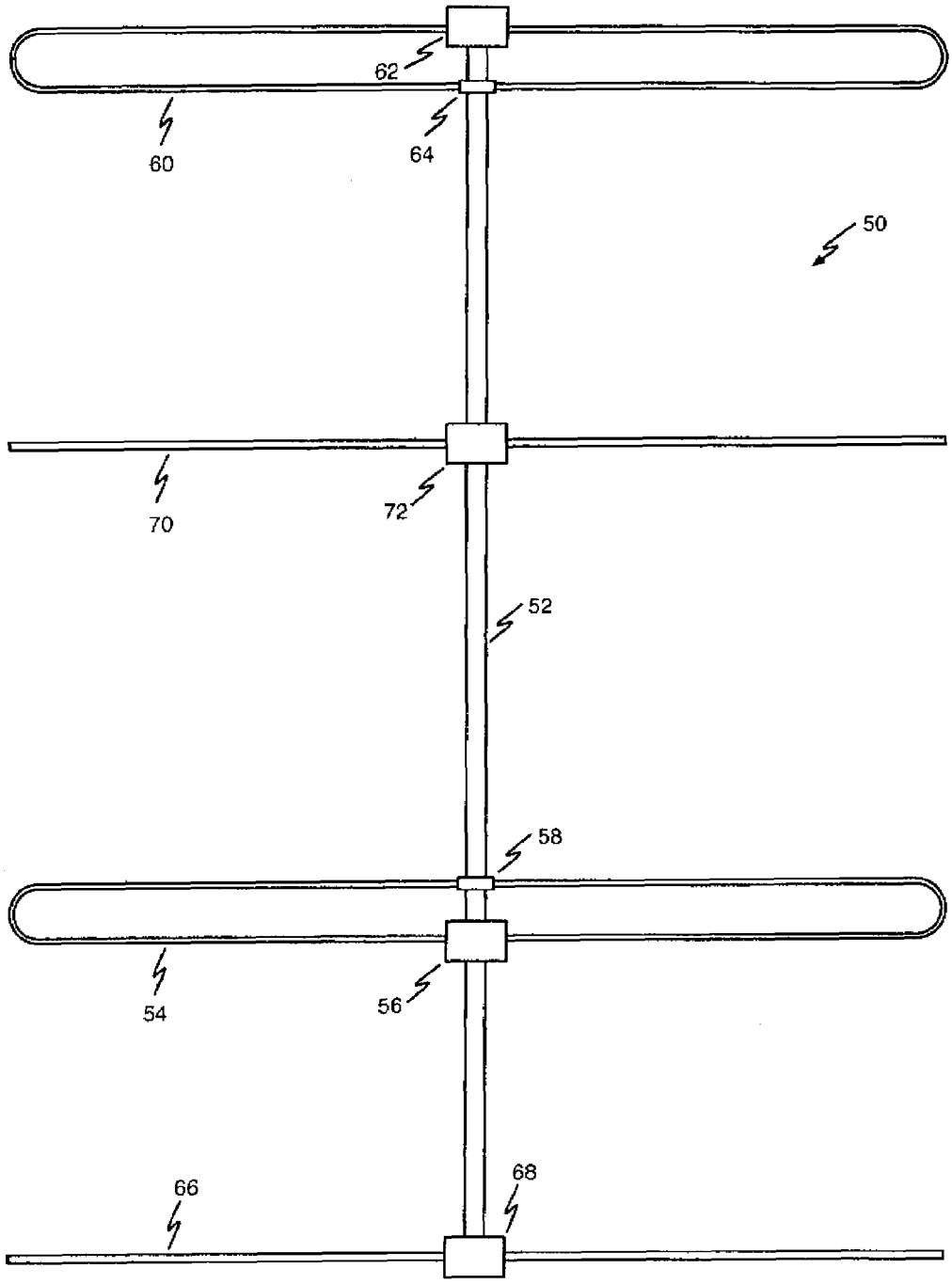
FIG. 3 is a drawing depicting an illustrative yagi antenna employing at least one adjustable antenna element according to the present invention.

Referring now to FIG. 3, a yagi type antenna 50 may be constructed using one or more adjustable antenna elements according to the present invention. These adjustable antenna elements may be used by themselves or in conjunction with adjustable antenna elements as disclosed in U.S. Pat. No. 6,677,914. Yagi antenna 50 is shown formed on boom 52 as is known in the art. A first adjustable antenna element 54, like the adjustable antenna element shown in FIG. 2 is used as the driven element. Its length is controlled by length adjuster 56, which is disposed in a housing that is used to mechanically secure the adjustable antenna element 54 to the boom. The distal end of the antenna element 54 may be mechanically fastened to the boom by means of a suitable clamp 58 as shown in FIG. 3. A transmission-line matching network may be used to couple the driven element 54 to a transmission line as is well known in the art.

A second adjustable antenna element 60 like the antenna element shown in FIG. 2 is placed at the end of the boom furthest away from the driven element 54. Its length is controlled by length adjuster 62 which is disposed in a housing that is used to mechanically secure the adjustable antenna element 60 to the boom. The distal end of the adjustable antenna element 60 may be mechanically fastened to the boom by means of a suitable clamp 64 as shown in FIG. 3.

A third adjustable antenna element 66 is mounted to the boom 52 at the end opposite to the end near which adjustable antenna element 54 is mounted. Its length is controlled by length adjuster 68 which is disposed in a housing that is used to mechanically secure the adjustable antenna element 66 to the boom 52.

Finally, a third adjustable antenna element 70 is mounted to the boom 52 between adjustable antenna elements 54 and 60. Its length is controlled by length adjuster 72 which is disposed in a housing that is used to mechanically secure the adjustable antenna element 70 to the boom 52.

Persons of ordinary skill in the art will appreciate that the spacing between adjustable antenna elements 54, 60, 66, and 70 will depend on the particular frequency range over which the antenna will be used and may easily be determined by persons of ordinary skill in the art using any one of a number of available antenna modeling software programs as is known in the art.

Such skilled persons will also appreciate that fewer or a larger number of length-adjustable elements may be included in a yagi antenna according to the principles of the present invention and that one or more fixed-length parasitic elements may also be disposed on boom 52 to interact with elements 54, 60, 66, and 70 at particular frequencies as disclosed in U.S. Pat. No. 6,677,914.

In one embodiment of the present invention, the total length from end to end of the elements of FIG. 2 is 38 feet, and the radius of curvature of the curved transition section is 12 inches, the yagi antenna of FIG. 3 may act as a two element antenna on 40 meters and 30 meters and any frequency in between, and as a four-element antenna on bands from 20 meters to 6 meters or higher.

In addition, a second feed line may be coupled to adjustable antenna element 60 to allow reversing the directivity of the antenna pattern without having to rotate the boom 52.

Length adjusters 56, 64, 68, and 72 are coupled to controller 74. During operation, the operator may use the controller 74 (and, for some but not all functions, the controllers 22 and 40 of FIGS. 1 and 2, respectively) to perform the following functions:

1. Single button band selection, including the ability to scroll through the band in segments of approximately 100 kHz.
2. Continuous adjustment of the antenna over its entire frequency range using simple up/down buttons (not shown).
3. Adjustment of the antenna by sensing the VSWR.
4. 180-degree direction change (Yagi version only) by changing the director to a reflector and changing the reflector to a director via a single button control, thus allowing very fast (less than 2 seconds) direction changes.
5. Bi-directional operation (Yagi only).
6. Store different antenna designs in the microprocessor memory that maximize gain only, front-to-back ratio only, or VSWR only.

Figure 4:
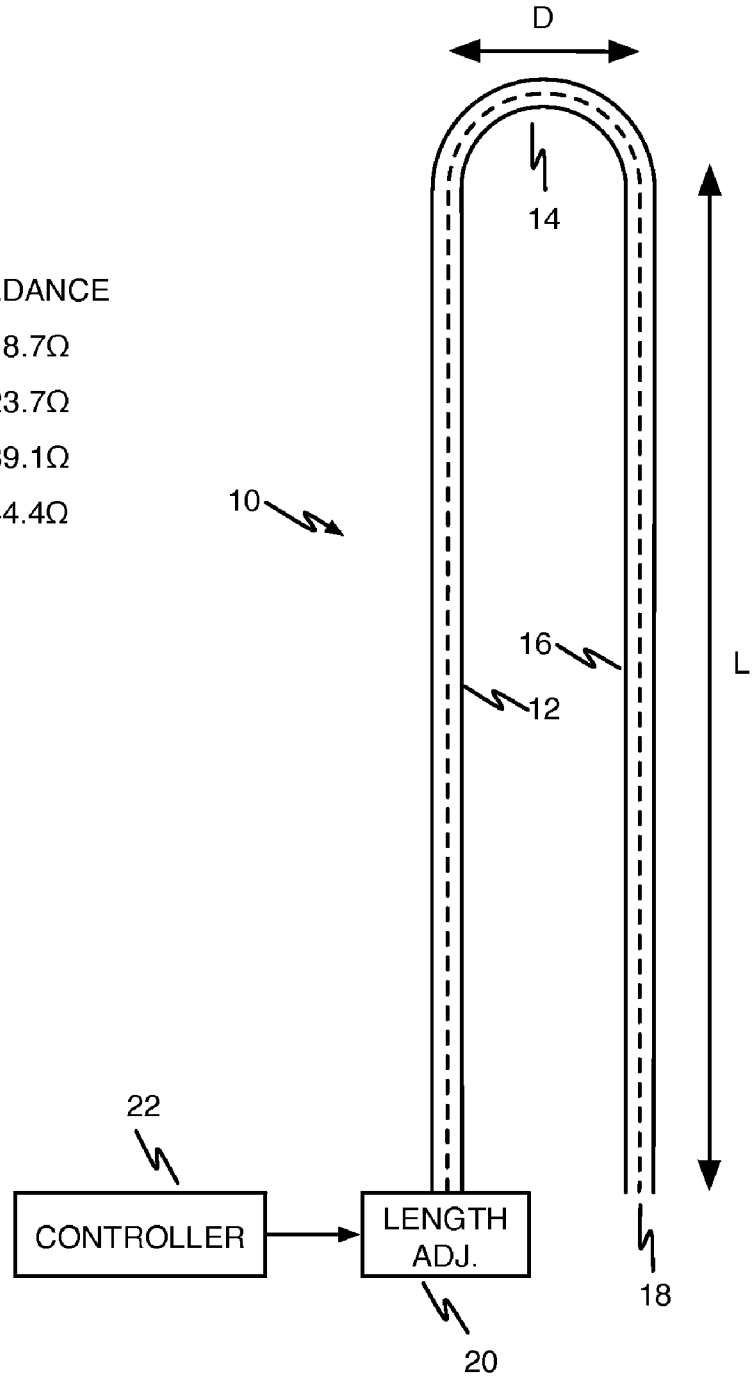
FIG. 4 is a drawing depicting the adjustable antenna element of FIG. 1 oriented in a vertical direction and showing the effects of element spacing and curvature diameter on characteristic impedance in free space.

Referring now to FIG. 4, FIG. 4 a drawing depicts the adjustable antenna element of FIG. 1 oriented in a vertical direction and shows the effects of element spacing and curvature diameter on characteristic impedance in free space. As depicted in FIG. 4, the antenna element of the present invention can be configured as a quarter-wavelength monopole vertical antenna.

When used as a quarter-wavelength monopole vertical antenna, the element of FIG. 4, some sort of counterpoise should be used. This may be in the form of one or more ground or above-ground radial elements as is well known in the antenna art.

As also may be seen from an examination of FIG. 4, the length L of the first and second sections 12 and 16 of the antenna element 10, as well as the diameter of curvature of the curved transition section 14, will affect the characteristic impedance of the antenna. Public domain antenna modeling software known as NEC-4, available from many sources as is known in the art, was used to model the antenna element of FIGS. 1 and 4, using exemplary lengths L of 38 feet and 46 feet, and exemplary curvature diameters D of 24 inches and 48 inches.

As shown in the table in FIG. 4, an antenna element 10 according to the present invention having a length L of 38 feet and a curvature diameter of 24 inches has a characteristic impedance of 18.7 ohms in free space. An antenna element 10 according to the present invention having a length L of 38 feet and a curvature diameter of 48 inches has a characteristic impedance of 23.7 ohms in free space. An antenna element 10 according to the present invention having a length L of 46 feet and a curvature diameter of 24 inches has a characteristic impedance of 39.1 ohms in free space. Finally, an antenna element 10 according to the present invention having a length L of 46 feet and a curvature diameter of 48 inches has a characteristic impedance of 44.4 ohms in free space.

From the above data, it may be seen that the characteristic impedance of an antenna element according to the present invention may be controlled by varying the length L of the first and second sections 12 and 16 and the curvature diameter of curved transition section 14.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A tunable antenna system, comprising:

a driven element, the driven element comprising a first support arm formed from non-conductive material and having a first section extending in a first direction for a first length, a curved transition section and a second section extending in a second direction for a second length, the first support arm being hollow and including a first length-adjustable conductive member disposed therein, and a second support arm formed from non-conductive material and having a first section extending in a first direction for a first length, a curved transition section and a second section extending in a second direction for a second length, the second support arm being hollow and including a second length-adjustable conductive member disposed therein;

length adjuster configured to adjust the lengths of the first and second conductive members disposed, respectively, in the first and second support arms; and a transmission-line coupler electrically coupled to the driven element.

2. The tunable antenna system of claim 1, wherein the first and second sections of both first and second support arms are parallel to one another.

3. The tunable antenna system of claim 1, further including a controller, coupled to the length adjuster, for causing the length adjuster to adjust the length of the conductive member in the driven element to resonate at a desired frequency.

4. The tunable antenna system of claim 3 wherein:

each of the first and second conductive members is wound on a spool; and the length-adjuster includes at least one motor coupled to the first and second conductive members and driven by the controller to selectively wind and unwind the first conductive member from its spool and into and out of the first support arm and to selectively wind and unwind the second conductive member from its spool and into and out of the second support arm to form an adjustable-frequency dipole element.

5. The tunable antenna system of claim 4, wherein the transmission-line coupler disposed in the housing and in electrical contact with the first and second conductive members at a position proximate to their spools.

6. The tunable antenna system of claim 4, wherein the controller includes a programmable microprocessor or microcontroller coupled to the motor to precisely control the length of the first and second conductive members.

7. The tunable antenna system of claim 4, wherein:

each of the first and second conductive members is formed as a flat strip including a series of spaced-apart holes formed along a lengthwise axis thereof;

the at least one motor is a bi-directional motor and is mechanically coupled to a sprocketed wheel mounted on a drive shaft, sprockets on the wheel engaging the series of spaced-apart holes , whereby when the bi-directional motor is activated, the sprocketed wheel winds and unwinds each of the first and second conductive members from its spool into and out of its support arm.

8. The tunable antenna system of claim 3, further including:

at least one non-driven element spaced apart from the driven element, the at least one non-driven element comprising a third support arm formed from non-conductive material and having a first section extending in a first direction for a first length, a curved transition section and a second section extending in a second direction for a second length, the third support arm being hollow and including a third conductive member disposed therein, the third conductive member being length-adjustable, and a fourth support arm formed from non-conductive material, the fourth support arm being hollow and including a fourth length-adjustable conductive member disposed therein, the fourth conductive member being length-adjustable; and a length-adjuster coupled to the controller and configured to adjust the lengths of the third and fourth conductive members.

9. The tunable antenna system of claim 8, wherein the length-adjuster in each of the driven element and the non-driven elements is disposed in a housing that mechanically supports the support arms.

10. The tunable antenna system of claim 8, wherein:

the length-adjuster for the driven element is disposed in a first housing that mechanically supports the first and second support arms; and the length-adjuster for the non-driven element is disposed in a second housing that mechanically supports the third and fourth support arms.

11. The tunable antenna system of claim 10, wherein the transmission-line coupler is disposed in the first housing and is in electrical contact with the first and second conductive members at a position proximate to their spools.

12. The tunable antenna system of claim 8, wherein:

each of the first and second conductive members is wound on a spool;

the length-adjuster for the driven element includes at least one first motor coupled to the first and second conductive members and driven by the controller to selectively wind and unwind the first conductive member from its spool and into and out of the first support arm and to selectively wind and unwind the second conductive member from its spool and into and out of the second support arm;

each of the third and fourth conductive members is wound on a spool;

the length-adjuster for the at least one non-driven element includes at least one second motor coupled to the third and fourth conductive members and driven by the controller to selectively wind and unwind the third conductive member from its spool and into and out of the third support arm and to selectively wind and unwind the fourth conductive member from its spool and into and out of the fourth support arm.

13. The tunable antenna system of claim 12, wherein the controller includes a programmable microprocessor or microcontroller coupled to the at least one first motor to precisely control the length of the first and second conductive members and coupled to the at least one second motor to precisely control the length of the third and fourth conductive members.

14. The tunable antenna system of claim 8, further including at least one fixed-length parasitic element spaced apart from the driven element, the fixed-length parasitic element having a length chosen to interact with the driven element to produce a desired azimuthal radiation pattern at a selected frequency.

15. The tunable antenna system of claim 8, wherein the controller includes a programmable microprocessor or microcontroller and is coupled to a non-volatile memory storing length data for the driven element and the at least one non-driven element.

16. The tunable antenna system of claim 15, wherein at least a portion of the length data corresponds to a plurality of selected antenna configurations.

17. The tunable antenna system of claim 16, wherein:

at least two non-driven elements are spaced apart from and aligned parallel to the driven element; and the controller is configured to operate in a mode in which data from the memory is used to adjust the lengths of the driven element and the at least two non-driven elements to configure them as a yagi-type antenna wherein one non-driven element acts as director element and another non-driven element acts as a reflector element.

18. The tunable antenna system of claim 17, wherein the controller is programmed to operate in a mode in which data from the memory is used to adjust the lengths of the at least two non-driven elements to reverse the identities of the director element and the reflector element.

19. The tunable antenna system of claim 18, wherein the transmission-line coupler is electrically coupled to the driven element through an impedance-matching network.

20. The tunable antenna system of claim 19, wherein the impedance-matching network is a unun and balun coupled between the driven element and the transmission-line coupler.

21. The tunable antenna system of claim 17, wherein the controller is configured to operate in a mode in which data from the memory is used to adjust the lengths of the at least two non-driven elements to reverse the identities of the director element and the reflector element to form a bi-directional antenna.

22. The tunable antenna system of claim 17, wherein the controller is programmed to operate in a mode in which data from the memory is used to adjust the lengths of the driven element and the at least one non-driven element to configure a yagi-type antenna for a selected frequency band in response to a user pressing a single button.

23. The tunable antenna system of claim 22, wherein the controller is programmed to operate in a mode in which data from the memory is used to adjust the lengths of the driven element and the at least one non-driven element to scroll through the selected frequency band in fixed frequency increments in response to a user pressing a single button.

24. The tunable antenna system of claim 17, wherein the controller is programmed to operate in a mode in which the individual lengths of the driven element, the director, and the reflector may be manually adjusted by a user.

25. The tunable antenna system of claim 16, wherein the controller is programmed to operate in a mode in which data from the memory is used to adjust the lengths of the driven element and the at least one non-driven elements by a selected frequency offset in response to a user pressing a single frequency-up or frequency-down button.

26. The tunable antenna system of claim 8, wherein the controller includes a programmable microprocessor or microcontroller and is programmed to operate in a mode in which the individual lengths of the driven element and the at least one non-driven elements may be manually adjusted by a user to form a user antenna configuration.

27. The tunable antenna system of claim 8, wherein:

the controller is programmed to operate in a mode in which the individual lengths of the driven element and the at least one non-driven element may be manually adjusted by a user to form a user antenna configuration; and the controller is programmed to operate in a mode in which a user may store the user antenna configuration in the memory.

28. The tunable antenna system of claim 8, further including an SWR-measuring circuit and wherein the controller includes a programmable microprocessor or microcontroller and is further programmed to operate in a mode that adjusts the lengths of the driven element and the at least one non-driven element to achieve a minimum SWR at a selected frequency.

29. The tunable antenna system of claim 8, further including a radio coupled to the controller, the radio communicating frequency data to the controller and wherein the controller is configured to operate in a mode in which the frequency data from the radio is used to adjust the length of the driven element and the at least one non-driven element to configure a yagi antenna resonant at a frequency represented by the frequency data.

30. The tunable antenna system of claim 8, further including an SWR-measuring circuit and wherein the controller includes a programmable microprocessor or microcontroller and is further programmed to operate in a mode that adjusts the lengths of the driven element and the at least two non-driven elements to achieve a minimum SWR at a selected frequency.

31. The tunable antenna system of claim 8, further including a radio coupled to the controller, the radio communicating frequency data to the controller and wherein the controller is configured to operate in a mode in which the frequency data from the radio is used to adjust the length of the driven element and the at least two non-driven elements to configure a yagi antenna resonant at a frequency represented by the frequency data.

32. The tunable antenna system of claim 3, further including an SWR-sensing circuit and wherein the controller includes a programmable microprocessor or microcontroller and is programmed to operate in a mode in which the length of the driven element is adjusted to achieve a minimum SWR at a selected frequency.

33. The tunable antenna system of claim 3, further including a radio coupled to the controller, the radio communicating frequency data to the controller and wherein the controller is configured to operate in a mode in which the frequency data from the radio is used to adjust the length of the driven element to resonate at a frequency represented by the frequency data.

34. The tunable antenna system of claim 1, wherein the length-adjuster is disposed in a housing that mechanically supports the first and second support arms.

35. The tunable antenna system of claim 34, wherein the first and second support arms are substantially straight and extend in opposite directions from the housing.

36. The tunable antenna system of claim 1, wherein each of the first and second support arms comprises a plurality of nested telescoping tube sections formed from the non-conductive material.

37. A tunable antenna system, comprising:

a driven element, the driven element comprising a support arm formed from non-conductive material and having a first section extending in a first direction for a first length, a curved transition section and a second section extending in a second direction for a second length, the support arm being hollow and including a length-adjustable conductive member disposed therein;

length adjuster configured to adjust the length of the conductive member disposed in the support arm; and a transmission-line coupler electrically coupled to the driven element.

38. The tunable antenna system of claim 37, wherein the first and second sections are parallel to one another and are oriented vertically.

39. The tunable antenna system of claim 38, further including a counterpoise system coupled to the antenna system.

* * * * *